United States Patent [19]

Wille et al.

[11] 4,353,051

[45] Oct. 5, 1982

[54] COIL FORM FOR ELECTRIC COILS

[75] Inventors: Roger Wille, Oostkamp, Belgium; Gerhard Meindl, Alling, Fed. Rep. of Germany

[73] Assignee: Siemens Aktiengesellschaft, Berlin and Munich, Fed. Rep. of Germany

[21] Appl. No.: 231,007

[22] Filed: Feb. 3, 1981

[30] Foreign Application Priority Data

Feb. 8, 1980 [DE] Fed. Rep. of Germany ..... 3004747

[51] Int. Cl.[3] ..... H01F 15/10; H01F 27/30

[52] U.S. Cl. ..... 336/192; 336/208

[58] Field of Search ..... 336/192, 198, 208; 310/71, 194; 242/7.06, 7.07

[56] References Cited

U.S. PATENT DOCUMENTS

| | | | |
|---|---|---|---|
| 3,117,294 | 1/1964 | Muszynski et al. | 336/198 X |
| 3,343,113 | 9/1967 | Dougall | 336/192 |
| 3,566,322 | 2/1971 | Horbach | 336/192 |
| 3,581,260 | 5/1971 | Andreis | 336/192 |

FOREIGN PATENT DOCUMENTS

| | | | |
|---|---|---|---|
| 1102911 | 3/1961 | Fed. Rep. of Germany | 336/192 |
| 2004344 | 8/1971 | Fed. Rep. of Germany | 336/192 |
| 1220473 | 5/1960 | France | 336/192 |
| 1034799 | 7/1966 | United Kingdom | 336/192 |

OTHER PUBLICATIONS

"Weakly Magnetic Siferrit and Sirufer Materials," Siemens Data Book, 1975/76, Order No. B24/1200, pp. 280–283 and 297–299.

*Primary Examiner*—Thomas J. Kozma

*Attorney, Agent, or Firm*—Herbert L. Lerner; Laurence A. Greenberg

[57] ABSTRACT

Coil form for electric coils including an elongated member having a flange at an end thereof, and means defining a peripheral winding space, the flange being formed with a rectilinear wire guide slots extending to the winding space, the slots being rounded at a transition between the slots and the winding space, and contact pin terminals extending from one side of the flange, the slots formed in the flange being at least partly widened at the one side of the flange from which the contact pin terminals extend, the slots, respectively, being partly defined by a flange portion formed as a wire catching beak.

2 Claims, 2 Drawing Figures

COIL FORM FOR ELECTRIC COILS

Figure 1:
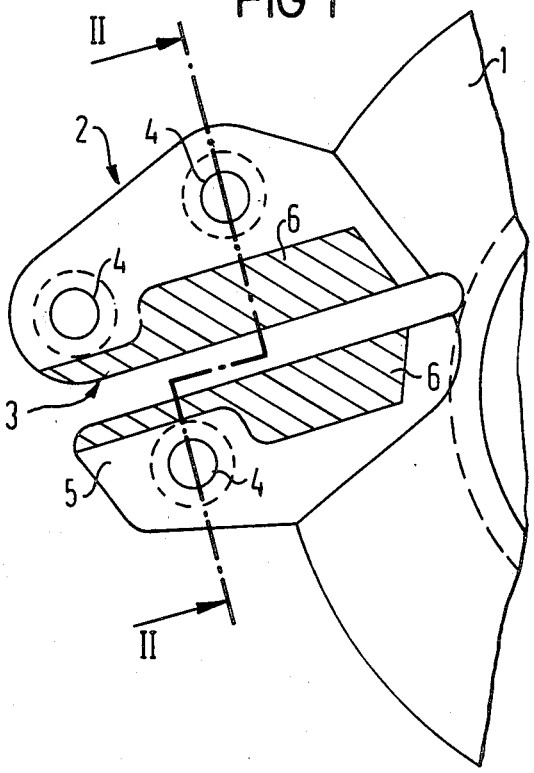

The invention relates to a coil form for electric coils and, more particularly, to such a coil form having a flange with wire guide slots and pin connections or terminals.

Heretofore known, commercially available coil forms with pin terminals i.e. so-called pin coil forms for RM and R cores, can be wound only on manual winding machines or semiautomatics without great difficulty. Such machines or devices obviously operate very slowly and, consequently, noneconomically.

When processing i.e. winding, these heretofore known coil forms on fully automatic winding devices, considerable difficulties arise with respect to production engineering matters contingent upon the partly curved wire guide slots of the pin flange of these known coil forms combined with absence of radius at the transition from the wire guide slot to the winding space of the coil form, a break in the wire becomes noticeable repeatedly when thin wires having the diameter somewhat smaller than 0.07 mm are being wound. Also, crossovers of the winding wires at the pin terminal side of the wire guide slots are not always able to be avoided. These wire crossings are short-circuited during the soldering operation and thereby result in coil failure. Especially with fully wound coil forms, the radii and the entire configuration of the inlet of the wire guide slots lead repeatedly to the sliding off of the winding wires and, thereby, to considerable production difficulties. All of these difficulties stand in the way of or preclude the processing of these heretofore known coil forms on fully automatic winding devices.

By modifying the structure of the coil form flange of such RM and R coil forms, respectively, which is studded with the contact pin terminals, the difficulties mentioned hereinbefore which occur in heretofore fully automatic production can be most largely avoided. The curved wire guide slots, in this regard, are straightened or made rectilinear and are rounded at a transition location from the wire guide slot to the winding space of the coil form. Such features may be readily added to conventional similar coil forms. Both of the foregoing features considerably reduce the number of wire breaks repeatedly occurring heretofore during processing i.e. winding, of thin wires.

It is accordingly an object of the invention to provide a coil form of the aforedescribed type which does not exhibit any of the hereinaforementioned disadvantages of the heretofore known coil forms of this general type.

With the foregoing and other objects in view, there is provided, in accordance with the invention, a coil form for electric coils comprising an elongated member having a flange at an end thereof, and means defining a peripheral winding space, the flange being formed with rectilinear wire guide slots extending to the winding space, the slots being rounded at a transition between the slots and the winding space, and contact pin terminals extending from one side of the flange, the slots formed in the flange being at least partly widened at the one side of the flange from which the contact pin terminals extend, the slots, respectively, being partly defined by a flange portion formed as a wire catching beak.

In accordance with another feature of the invention, the wire guide slots are conically widened or flared.

In this regard, it is noted that the wire-catching beak construction is such that a strap or bridge-like part of the flange at the end of the coil form, which leads to the wire guide slot inlet, is in the shape of a nose or beak.

Due to this widening of the wire guide slots, the crossover location of the winding wires, which are unavoidable in part, are shifted out of the hazardous soldering zone into the slots of the coil form flange. In this manner, short circuits, which repeatedly occur when soldering the contact points of heretofore known coil forms, are avoided.

This widening of the wire guide slots provides advantages also in the production of the coil forms because, due to this modification, easier removal or trimming of the, for example, duroplastic synthetic material parts, which is effected by a blasting process, is afforded.

The wire catching beaks have dimensions which are maintained advantageously within the provided installation dimensions of the respective coil sizes, for which reason these coils require no very large base surface on the guide plate. Due to these wire catching beaks or noses, the winding wires, especially for fully wound coils, are compulsorily guided into the respective wire guide slots of the coil forms. Sliding off of the winding wires, as repeatedly occurs with the heretofore known coil forms, is consequently no longer possible.

Other features which are considered as characteristic for the invention are set forth in the appended claims.

Although the invention is illustrated and described herein as embodied in a coil form for electric coils, it is nevertheless not intended to be limited to the details shown, since various modifications and structural changes may be made therein without departing from the spirit of the invention and within the scope and range of equivalents of the claims.

Figure 2:
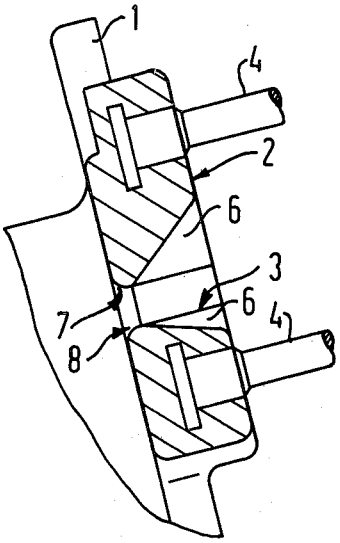

The construction and method of operation of the invention, however, together with additional objects and advantages thereof will be best understood from the following description of specific embodiments when read in connection with the accompanying drawings, in which:

FIG. 1 is a fragmentary bottom plan view of a coil form according to the invention; and FIG. 2 is a cross-sectional view of FIG. 1 taken along the line II—II in direction of the arrows.

Referring now to the figures of the drawing there is shown one of the coil form flanges 1 of a coil form, for example, for RM and R cores, whereon bars or bridges 2, only one of which is illustrated, are integrally formed. Such bars or straps 2 serve as supports for contact pin terminals 4 and are formed with rectilinear or straight wire guide slots 3. The wire guide slots 3 are inclined so as to widen toward the part thereof facing toward the contact pin terminal side (note the surfaces 6 indicated by single-line hatching in FIG. 1). The contact pin terminals 4, as shown in FIG. 2, are embedded in the bar or bridge 2, preferably cast therein.

The bar part 5, because of the especially beak-like shape thereof, serves as a wire catching beak which ensures that the winding wires are forcibly guided into the wire guide slot 3. At a transition point between the wire guide slot 3 and the winding space on the periphery of the cylindrical drum part of the coil form, the wire guide slot 3 is rounded at 7 and 8, as shown in FIG. 2.

There is claimed:

1. Coil form for electric coils comprising a coil core having end flanges defining a winding space therebetween, one of said end flanges being formed with bars extending transversely to said coil core and having elongated rectilinear wire guide slots formed therein and open at one end thereof, said bars being rounded in direction transverse to longitudinal direction of said slots at a transition location between said slots and said winding space, said bars carrying contact pin terminals for connection with wires wound on the coilform and having a part thereof formed as a wire catching beak for forcibly guiding into the respective wire guide slots winding wires which are to be connected by soldering to said contact pin terminals, said bars having surfaces defining said wire guide slots, said surfaces being inclined in direction of said contact pin terminals, said wire guide slots being widened in vicinity of said contact pin terminals and in a direction transverse to longitudinal direction of said slots so that crossover locations of the winding wires are shifted out of a zone wherein the winding wires are soldered to the contact pin terminals and into said wire guide slots.

2. Coil form according to claim 1 wherein said wire guide slots are conically widened.

* * * * *